US007376379B2

(12) United States Patent
Takahashi et al.

(10) Patent No.: US 7,376,379 B2
(45) Date of Patent: May 20, 2008

(54) METAL BELT, FIXING BELT AND HEAT FIXING DEVICE

(75) Inventors: Junichi Takahashi, Chichibu (JP); Yaomin Zhou, Hanno (JP); Koji Sasaki, Chichibu-gun (JP); Makoto Miyagi, Chichibu (JP); Nobuhiro Arai, Honjo (JP)

(73) Assignee: Canon Denshi Kabushiki Kaisha, Chichibu-Shi (JP)

( * ) Notice: Subject to any disclaimer, the term of this patent is extended or adjusted under 35 U.S.C. 154(b) by 0 days.

(21) Appl. No.: 10/580,334

(22) PCT Filed: Dec. 2, 2004

(86) PCT No.: PCT/JP2004/018331

§ 371 (c)(1),
(2), (4) Date: May 24, 2006

(87) PCT Pub. No.: WO2005/054960

PCT Pub. Date: Jun. 16, 2005

(65) Prior Publication Data

US 2007/0147914 A1 Jun. 28, 2007

(30) Foreign Application Priority Data

Dec. 2, 2003 (JP) ..... 2003-402911

(51) Int. Cl.
*G03G 15/20* (2006.01)

(52) U.S. Cl. ..... 399/329

(58) Field of Classification Search ..... 399/328, 399/329, 333

See application file for complete search history.

(56) References Cited

U.S. PATENT DOCUMENTS

| | | | | |
|---|---|---|---|---|
| 5,568,240 | A | 10/1996 | Ohtsuka | |
| 5,778,293 | A | 7/1998 | Ohtsuka | 399/329 |
| 6,078,780 | A | 6/2000 | Abe et al. | 399/328 |
| 6,456,819 | B1 * | 9/2002 | Abe et al. | 399/329 |
| 6,561,001 | B2 | 5/2003 | Sakuma et al. | 72/85 |

(Continued)

FOREIGN PATENT DOCUMENTS

JP 6-75489 3/1994

(Continued)

OTHER PUBLICATIONS

International Preliminary Report Aug. 3, 2006, for PCT/JP2004/018331 filed Dec. 2, 2004.

*Primary Examiner*—Sandra L. Brase
(74) *Attorney, Agent, or Firm*—Fitzpatrick, Cella, Harper & Scinto

(57) ABSTRACT

Provided are a metal belt which is improved in wear resistance, thermal conductivity, thin wall designs, heat resistance and flexibility, a fixing belt in which this metal belt is used, and a high durability and high reliability heat fixing device which has this fixing belt. This metal belt is made of a nickel-iron alloy manufactured by an electroforming process, and the nickel-iron alloy satisfies relationships expressed by the following equations:

$$0.001 \leqq S \leqq 0.13, \text{ and} \quad (1)$$

$$85 \times S+3 \leqq F \leqq 350 \times S+3 \quad (2)$$

wherein S represents a sulfur content (mass %) and F represents an iron content (mass %).

12 Claims, 6 Drawing Sheets

U.S. PATENT DOCUMENTS

| | | | | |
|---|---|---|---|---|
| 6,564,033 | B2 | 5/2003 | Zhou et al. | 399/329 |
| 6,597,888 | B1 * | 7/2003 | Abe et al. | 399/329 |
| 6,782,230 | B2 * | 8/2004 | Yaomin et al. | 399/333 X |
| 6,898,397 | B2 | 5/2005 | Sakuma et al. | 399/159 |
| 7,215,916 | B2 | 5/2007 | Kishino et al. | 399/329 |
| 2002/0146259 | A1 * | 10/2002 | Zhou et al. | 399/329 |
| 2003/0173356 | A1 * | 9/2003 | Yano et al. | 219/619 |

FOREIGN PATENT DOCUMENTS

| | | |
|---|---|---|
| JP | 6-222695 | 8/1994 |
| JP | 7-13448 | 1/1995 |
| JP | 7-48691 | 2/1995 |
| JP | 7-114276 | 5/1995 |
| JP | 7-263614 | 10/1995 |
| JP | 9-44014 | 2/1997 |
| JP | 10-48976 | 2/1998 |
| JP | 2001-6868 | 1/2001 |
| JP | 2001-225134 | 8/2001 |
| JP | 2002-258648 | 9/2002 |

* cited by examiner

METAL BELT, FIXING BELT AND HEAT FIXING DEVICE

TECHNICAL FIELD

The present invention relates to a metal belt, a fixing belt and a heat fixing device which conducts, under heat applied, fixation of an unfixed image which is formed and carried on a recording material, the metal belt, the fixing belt and the heat fixing device being used in an image forming apparatus such as an electrophotographic apparatus, an electrostatic recording apparatus and the like.

BACKGROUND ART

In an image forming device, the heat roller type fixing device has been widely used as a fixing device which thermally fixes an unfixed image (a toner image) of object image information, which is formed and carried on a recording material (a transfer material sheet, an electrofax sheet, a sheet of electrostatic recording paper, an OHP sheet, a sheet of printing paper, a sheet of format paper and the like) by the transfer method or the direct method, on the recording material surface as a permanently fixed image in an image forming process means section of an electrophotographic process, an electrostatic recording process, a magnetic recording process and the like. In a fixing device of the heated roller type, it is general practice to use a heat source such as a halogen heater within the roller.

On the other hand, there have been widely proposed and carried out fixing devices of a type in which a resin belt or a metal belt having a small heat capacity is heated by using a ceramics heater as a heat source. That is, in fixing devices of this heating type, generally, a nip portion is formed by nipping a heat resistant belt (a fixing belt) between a ceramics heater as a heating body and a pressure roller as a pressurizing member, a recording material, on which an unfixed toner image to be fixed is formed and carried, is introduced between the fixing belt in the nip portion and the pressure roller, and the recording material is supported in a sandwiching manner and transported together with the belt, whereby in the nip portion, the heat from the ceramics heater is given to the recording material via the belt and the unfixed toner image is hot pressed and fixed on the surface of the recording material by this heat and the pressure load in the nip portion.

In this fixing device of the belt heating type, it is possible to make up a device of an on-demand type by using a small heat capacity member as a belt. That is, it is only necessary that the belt be heated to a prescribed fixing temperature by energizing the ceramics heater as a heat source only when the image formation is executed by the image forming apparatus. The fixing device of this type is advantageous in a short waiting time from the power-on operation of the image forming apparatus to a state in which the image formation can be executed (quick start capabilities) and a very small power consumption in a standby condition (electric power saving). FIG. 3 shows an example of the construction of a heat fixing device of this type. In the heat fixing device of this type, a nip portion N is formed by sandwiching a heat resistant belt (a fixing belt 310) between a ceramics heater 312 as a heating body and a pressure roller 330 as a pressurizing member, a recording material P, on which an unfixed toner image t to be fixed is formed and carried, is introduced between the fixing belt 310 at the nip portion and the pressure roller 330, and the recording material P is supported in a sandwiching manner and transported together with the belt 310, whereby in the nip portion, the heat from the ceramics heater 312 is given to the material P to be recorded via the belt 310 and the unfixed toner image t is hot pressed and fixed on the surface of the recording material P by this heat and the pressure load of the nip portion.

Heat resistant resins and the like are used as the material for the belt in such a belt heating type fixing device, including polyimide resins which are especially excellent in heat resistance and strength. However, in machines of high speed design and high durability design, the strength of resin films is insufficient. For this reason, the use of belts having a base layer made of metals excellent in strength, for example, stainless steel, nickel, copper and aluminum, has been proposed.

The Japanese Patent Application Laid-Open Nos. H07-114276 and 2001-006868 disclose an induction heating type in which a metal belt is used and the self-heating of this belt is caused to occur by an eddy current caused by electromagnetic induction. FIG. 4 shows an example of the construction of a heat fixing device of this heating type. FIG. 5 shows a schematic illustration of magnetic field generating means of the heat fixing device of FIG. 4. Magnetic cores 417*a*, 417*b* and 417*c* are members with high magnetic permeability, and an exciting coil 418 generates an alternating magnetic flux by an alternating current (a high frequency current) supplied from an exciting circuit (not shown). When this alternating magnetic flux acts on a metal layer of a fixing film, an eddy current is generated to heat the metal layer. This heat heats the fixing film via an elastic layer and a release layer of the fixing film and heats a recording material P which is fed to a nip portion N, whereby a toner image is thermally fixed. That is, there has been proposed a heat fixing apparatus in which an eddy current is generated in the belt itself or an electrically conductive member provided very close to the belt by the magnetic flux and heat is generated by the Joule heat. In a heat fixing device of this electromagnetic induction heating type, the efficiency of consumed energy can be increased because the heat generation region can be provided closer to a body to be heated.

Methods of driving a fixing belt of a heat fixing device of the belt heating type include a method in which a belt which is brought into pressure contact with a film guide which guides an inner surface of the belt and a pressure roller is driven and rotated by the rotational driving of the pressure roller (the pressure roller driving method), and a method in which conversely, a pressure roller is driven and rotated by the driving of a belt in endless belt form which is set up in a tensioned condition by a driving roller and a tension roller.

The Japanese Patent Application Laid-Open No. H07-013448 discloses as a fixing belt which is a metal belt, a fixing belt made of nickel having a thickness of 40 μm or so in which the surface roughness of a contact portion of a heater surface is less than 0.5 μm. The Japanese Patent Application Laid-Open No. H06-222695 discloses a fixing belt of nickel with a thickness of 10 to 35 μm, having a coating layer having release characteristics on an outer circumferential surface and a resin layer on an inner circumferential surface.

As described above, generally, a seamless belt base material is used in a fixing belt which is employed in an image forming apparatus such as an electrophotographic apparatus, an electrostatic recording apparatus and the like. For example, a seamless belt base material formed from a nickel material is generally fabricated by an electroplating process (which may sometimes be called an electroforming process) which uses a nickel sulfate bath, nickel sulfamate or the like.

In this electroplating process, a mother mold having a prescribed shape is used, film formation by electroforming is performed on the outer circumference of the mother mold, and a seamless belt base material is produced by being extracted from the mother mold. However, in a conventional nickel seamless belt, the surface is oxidized when heated to not less than 180° C. during fixing. In the case of the heat fixing device of the belt heating type shown in FIG. 3, for example, the surface is scraped off due to contact with the ceramics heater 312 and the belt guide 316 and frictional resistance increases. For this reason, a torque of the fixing belt driven by the pressure roll (pressurizing member) 330 increases and it becomes impossible to obtain designed rotations.

Therefore, it has hitherto been general practice to provide a sliding layer on the belt guide side (inner surface) of the seamless belt base material. The purpose is to reduce the resistance due to contact of the fixing belt with the belt guides 316, 416*a* and 416*b* and sliding plates 340, 440 in FIGS. 3 and 4. It has been proposed to form a sliding layer by using polyimide resin. However, because the thermal conductivity of what is called resin-based materials including polyimide resin is approximately 300 times as low as the thermal conductivity of nickel, which is the base material, (nickel 0.92 W/cm·° C., polyimide resin $2.9\times10^{-3}$ W/cm·° C.), the start-up time becomes long and the advantage of the nickel materials that thermal conductivity is good disappears. Polyimide resin requires high material costs, and process costs also increase because a polyimide resin film is formed on the inner surface of the belt. Furthermore, there are many cases where during the film forming process of polyimide resin, moisture is absorbed in the polyimide film and the excellent characteristics of polyimide are lost.

On the other hand, the Japanese Patent Application Laid-Open No. 2001-006868 discloses a lubricating metal layer which is such that ceramics particles or synthetic resin particles are dispersed in a metal matrix, the lubricating metal layer being formed on the surface of a heating member sliding with a support member. By providing a metal layer which is such that ceramics particles or synthetic resin particles are dispersed in a metal matrix, it is possible to reduce the sliding resistance of the surface of the heating member sliding with the support member and also to suppress an increase in the sliding resistance by an improvement of paper-feed durability. However, because the thermal conductivity is still small compared to nickel, which is the base material, this small thermal conductivity remains to be a problem to be solved in increasing the printing speed of a heat fixing device.

On the other hand, the Japanese Patent Application Laid-Open No. 2001-225134 proposes a metal tube produced by plastic forming methods. The plastic forming methods include drawing, pultrusion, processing method which involves pultruding a base material during drawing, and the like. When the thickness of a tube is to be reduced, for example, in the case of the pultrusion, it has drawbacks such that the wear of dies occurs frequently, the thickness cannot be reduced (thickness: not more than 30 μm), and the like.

In the future, requirements for energy saving and space saving will become increasingly severe, and small designs of a heat fixing device used in an image forming apparatus and small designs of the inside diameter of a fixing belt are being pursued. Therefore, a fixing belt having a metal layer is required to provide oxidation resistance at high temperatures, lubricity, thermal conductivity, thin wall designs, heat resistance, flexibility and the like.

DISCLOSURE OF THE INVENTION (Problems to be Solved by the Invention)

The present invention has been made to solve the above-described problems in conventional techniques and the object of the invention is to provide a fixing belt which is improved in wear resistance, thermal conductivity, thin wall designs, heat resistance and flexibility for use in a heat fixing device which permits low energy heating, and the heat fixing device. Also, the object of the invention is to provide a metal belt having excellent wear resistance, heat resistance and flexibility.

(Means for Solving the Problems)

A metal belt according to the present invention is characterized in that the metal belt is made of a nickel-iron alloy manufactured by an electroforming process and that when the iron content of the nickel-iron alloy is denoted by F (mass %) and the sulfur content is denoted by S (mass %), the nickel-iron alloy satisfies relationships expressed by the following equations:

$$0.001 \leqq S \leqq 0.13 \text{ and}$$

$$85\times S+3 \leqq F \leqq 350\times S+3.$$

A fixing belt according to the present invention is characterized in that the fixing belt has a metal layer and that the metal layer is the above-described metal belt. A heat fixing device according to the present invention is characterized in that the heat fixing device has a fixing belt and a pair of pressure contact members which are in pressure contact with each other via the fixing belt, that an inner surface of the fixing belt slides with one of the pair of pressure contact members, that an image is fixed on a recording material by heat from the fixing belt, and that the fixing belt is the above-described fixing belt.

(Effect of the Invention)

By ensuring that in a metal belt of a nickel-iron alloy manufactured by an electroforming process, the sulfur content S and the iron content F satisfy relationships expressed by the following equations:

$$0.001 \leqq S \leqq 0.13 \text{ and}$$

$$85\times S+3 \leqq F \leqq 350\times S+3$$

it is possible to provide a thin-walled metal belt having excellent wear resistance, heat resistance suitable for high-speed printing, thermal conductivity, flexibility and flexing characteristics and by using this metal belt in a fixing belt, it is possible to provide a heat heating device which has high reliability.

BEST MODE FOR CARRYING OUT THE INVENTION

A fixing belt of the present invention is characterized in that the fixing belt has at least a metal layer and a release layer, that the metal layer is made of a nickel-iron alloy manufactured by an electroforming process, and that when the iron content of the nickel-iron alloy is denoted by F mass % and the sulfur content is denoted by S mass %, the nickel-iron alloy satisfies relationships expressed by the following equations:

$$0.001 \leqq S \leqq 0.13 \text{ and}$$

$$85 \times S + 3 \leqq F \leqq 350 \times S + 3.$$

That a nickel-iron alloy is manufactured by an electroforming process means that a nickel-iron alloy is manufactured by an electroplating process.

If the iron and sulfur contents of the nickel-iron alloy satisfy the above-described relationships, it is possible to obtain a metal layer having high heat resistance and high flexing characteristics to such an extent that an increase in the hardness of metal layer, cracking and the like do not occur, for example, during heating in forming and curing an elastic layer and a release layer on the metal layer and during heating for fixing.

Figure 3:
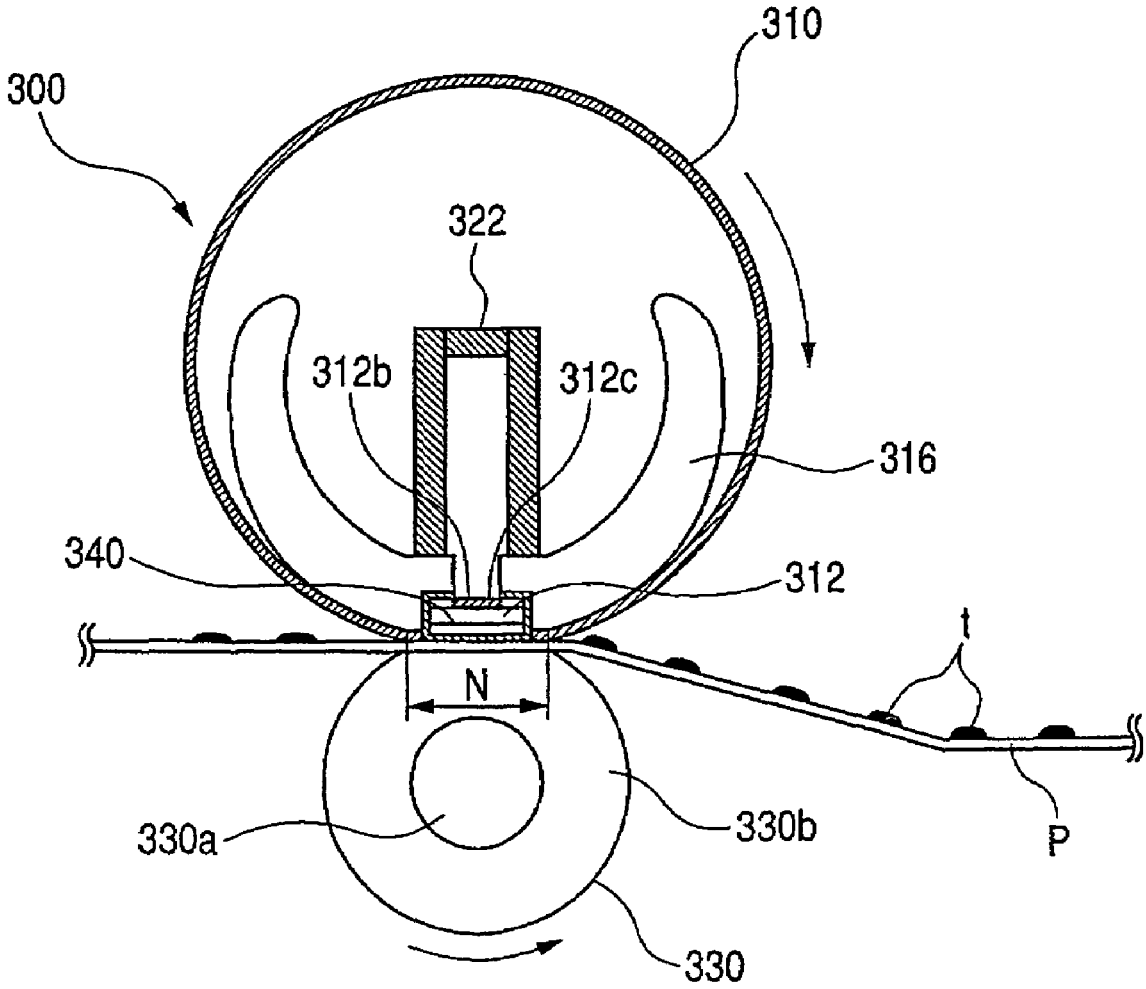
FIG. 3 is a configuration diagram which shows a first embodiment of a heat fixing device of the present invention.

Electroformed nickel of the prior art has disadvantages in that as described above, the surface is oxidized by the heating (at not less than 180° C.) during fixing, and that as shown in FIG. 3, the surface is scraped off due to contact with the ceramics heater 312 and the belt guide 316. However, a nickel-iron alloy manufactured by the above-described electroforming process of the present invention exhibits excellent sliding characteristics even at high temperatures. That is, using a fixing belt of the present invention in a heat fixing device makes it possible to provide an improved heat fixing device the surface of which is not scraped off even if the metal layer of the fixing belt comes into contact with a structure opposed to the fixing belt and which has wear resistance, good slip characteristics, and sufficient heat resistance and flexing characteristics. Details of the present invention will be described below.

(1) Fixing Belt

A fixing belt of the present invention will be described.

Figure 1:
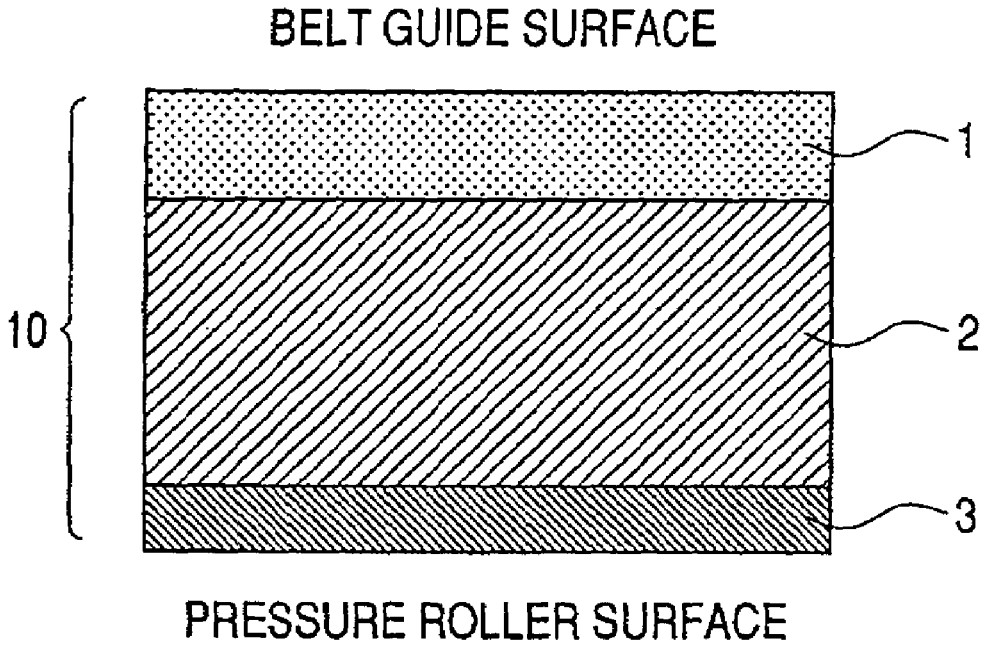
FIG. 1 is a schematic diagram which shows the layer construction of a fixing belt in an embodiment of the present invention.

FIG. 1 is a schematic diagram which shows the layer construction of a fixing belt 10 in an embodiment of the present invention. The fixing belt 10 of the present invention shown in FIG. 1 has a metal layer 1 formed from an endless metal belt manufactured by an electroforming process, an elastic layer 2 laminated on an outer surface of this metal layer, and a release layer 3 laminated on an outer surface of this elastic layer. The metal layer 1 is constituted by a nickel-iron alloy manufactured by an electroforming process. In the fixing belt 10, the metal layer 1 side is the inner surface side (belt guide surface side), and the release layer 3 side is the outer surface side (pressure roller surface side). A primer layer (not shown) for bonding may be provided each between the metal layer 1 and the elastic layer 2 and between the elastic layer 2 and the release layer 3. Publicly known silicone-based, fluorine-based, epoxy-based, polyamideimide-based and other primer layers may be used as the primer layer, and the thickness of the primer layer is usually 1 to 10 μm or so.

Figure 2:
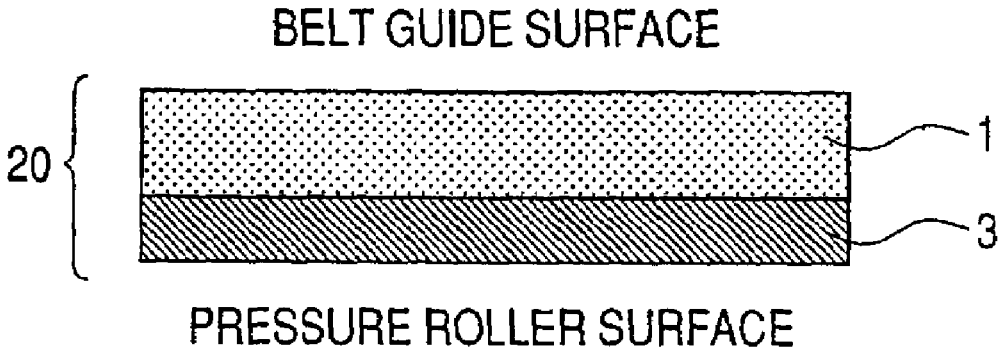
FIG. 2 is a schematic diagram which shows the layer construction of a fixing belt in another embodiment of the present invention.

FIG. 2 is a schematic diagram which shows the layer construction of a fixing belt 20 in another embodiment of the present invention. A release layer 3 may be formed directly on a metal layer 1 without forming an elastic layer 2 on a surface of the metal layer 1. Particularly, in a case where heat fixing is performed when the toner laid-on amount on a recording material is small and the toner layer has relatively small irregularities and in a case where the layer construction is intended for transmitting heat, it is possible to adopt such a form in which an elastic layer is omitted.

On the other hand, even in the case of the fixing belts shown in FIGS. 1 and 2, if it is necessary to provide insulating characteristics with respect to the belt guide and the like for reasons of the mechanism of the heat fixing device, there is no problem in the formation of a resin layer of a material having high heat resistance such as polyimide, polyamide-imide or the like on the belt guide side of the metal layer 1. Also, a solid lubricant for the sliding with the belt guide and an oxide filler for improving thermal conductivity may be added to this resin layer. The thickness of this resin layer is not more than 50 μm, and particularly it is preferred that the thickness be 3 to 20 μm or so. The fixing belt 10 or 20 of the present invention can be used in a heat fixing device of a belt heating type in which a ceramics heater is used and of an electromagnetic induction heating type.

<Metal Layer>

The metal layer 1 is formed from an endless metal belt manufactured by an electroforming process, and this endless metal belt is made of a nickel-iron alloy. In the present invention, the nickel-iron alloy which constitutes this metal layer 1 is such that the iron and sulfur contents satisfy the following relationships when the iron content is denoted by F mass % and the sulfur content is denoted by S mass %:

$$0.001 \leqq S \leqq 0.13, \text{ and} \quad (1)$$

$$85 \times S + 3 \leqq F \leqq 350 \times S + 3. \quad (2)$$

It has become apparent that the metal layer 1 formed from the above-described nickel-iron alloy is excellent in wear resistance compared to a metal layer made of nickel even when heated to a temperatures of not less than 180° C. at the time of heat fixing. This is because oxides of iron are excellent in wear resistance.

However, it has become apparent that when the iron content increases, hardness increases after heating from the level before heating. In a case where a metal layer is fabricated by an electroforming process, generally, the component sulfur is an essential component which reduces electrodeposition stresses and improves molding accuracy. On the other hand, the component sulfur impairs flexibility and high-temperature elasticity and is closely related to fracture phenomena by metal fatigue. Hardness is particularly influenced by the sulfur content. When the sulfur content increases, heating results in an increase in the hardness of a metal layer and the metal layer tends to become brittle. When an elastic layer and a release layer are formed on an outer surface of the metal layer 1, the metal layer 1 is usually heated to 200 through 300° C. and hardened. However, the hardness of the metal layer 1 increases due to the heating on this occasion and the metal layer 1 becomes brittle. Therefore, cracks and fissures are formed during fixing. That is, the flexing characteristics become worse.

In general, it is known that iron and sulfur combine to form a compound called FeS and that this FeS becomes very brittle. However, the present inventors found out that when the iron and sulfur contents of the nickel-iron alloy satisfy the above-described relationships, a change in the hardness of the metal layer 1 due to heating is small. Although the reason for this is unclear, it might be thought that for example, when the iron content increases, crystal grain boundaries tend to become small, and hence many crystal grains exist, with the result that many crystal grain boundaries exist and hence FeS which is formed exists only discontinuously.

In the case of a metal layer formed from a nickel-iron alloy manufactured by an electroforming process, it became apparent that for the sulfur content, contents up to 0.13 mass % can satisfy the flexing characteristics for the metal layer 1 of a fixing belt of the present invention when the relation of the sulfur content to the iron content is taken into consideration. If the sulfur content is too small, it becomes difficult to remove the metal layer from the mother mold and, therefore, for the sulfur content of a nickel-iron alloy which constitutes the metal layer 1 in the present invention, a sulfur content of at least 0.001 mass % is necessary. Particularly, preferred sulfur contents are from 0.02 to 0.09 mass %.

It became apparent that the addition of carbon is effective in increasing heat resistance. It is preferred that the carbon content of a nickel-iron alloy of the metal layer 1 in the present invention be 0.07 to 2 times the sulfur content, particularly 0.08 to 1.5 times the sulfur content. Carbon tends to suppress the formation of compounds of iron and sulfur. However, if the carbon content is larger, carbon compounds of iron increase and hence the metal layer becomes brittle. It is also possible to cause cobalt (Co), chromium (Cr), molybdenum (Mo), tungsten (W) and the like to be contained in a nickel-iron alloy in the present invention to further improve the heat resistance by using a plating liquid which is obtained by adding plating liquids of these components to a nickel-iron alloy bath, which is the base plating liquid.

An endless nickel-iron alloy belt having the above-described prescribed iron and sulfur contents which is used in the present invention is manufactured by an electroforming process using a mother mold made of, for example, stainless steel as a cathode. As the plating bath, it is general practice to use a usual plating bath, such as a sulfate bath, a sulfamate bath and a chloride bath. In the case of a sulfuric acid bath, an aqueous solution which contains, for example, nickel sulfate, ferrous sulfate, boric acid, sodium chloride, saccharin sodium and sodium lauryl sulfate, is used as the base. Additives such as a pH adjuster, a pit inhibitor and a brightener may be appropriately added to this bath.

In order to ensure that the sulfur content of a nickel-iron alloy which constitutes the above-described nickel-iron alloy endless belt satisfies the above relationship (1), it is necessary only that, for example, the amounts of added ferrous sulfate and saccharin sodium, plating current density and plating bath temperature be controlled.

In order to ensure that the iron content satisfies the above relationship (2), it is necessary only that, for example, the amounts of added nickel sulfate and ferrous sulfate, current density and plating bath temperature be controlled.

In order to ensure that the carbon content is 0.07 to 2 times the sulfur content, it is necessary only that, for example, the amount of added brightener, such as butyne diol and coumalin, the amount of added saccharin sodium, current density and plating bath temperature be controlled.

It is preferred that usually electroforming be performed at plating bath temperatures of 40 to 60° C. or so and at cathode current densities of 1 to 100 A/dm$^2$ or so, although this depends on the plating bath used in the electroforming process.

As the brightener, it is possible to add brighteners called stress-reducing agents and primary brighteners, such as saccharin, saccharin sodium, sodium benzensulfonate and sodium naphthalene sulfonate, and brighteners called secondary brighteners, such as butyne diol, coumalin and diethyltriamine.

In a case where the metal layer 1 is used in the heat fixing device of the belt heating type using a ceramics heater shown in FIG. 3, in order to increase quick start capabilities by reducing the heat capacity, it is preferred that the thickness of the metal layer 1 be not more than 100 μm, particularly not more than 50 μm but not less than 10 μm. Because the electroformed nickel-iron alloy in the present invention has higher spring characteristics than electroformed nickel, the electroformed nickel-iron alloy undergoes less plastic deformation even if it is made thinner than electroformed nickel. It is desirable to reduce the thickness of the metal layer 1 in order to increase the size of the nip portion with the pressure roller, and thin metal layers will have many needs in the future. In this respect, the electroformed nickel-iron alloy in the present invention is more advantageous than stainless steel (SUS) tubes fabricated by the above-described plastic forming processes.

Figure 4:
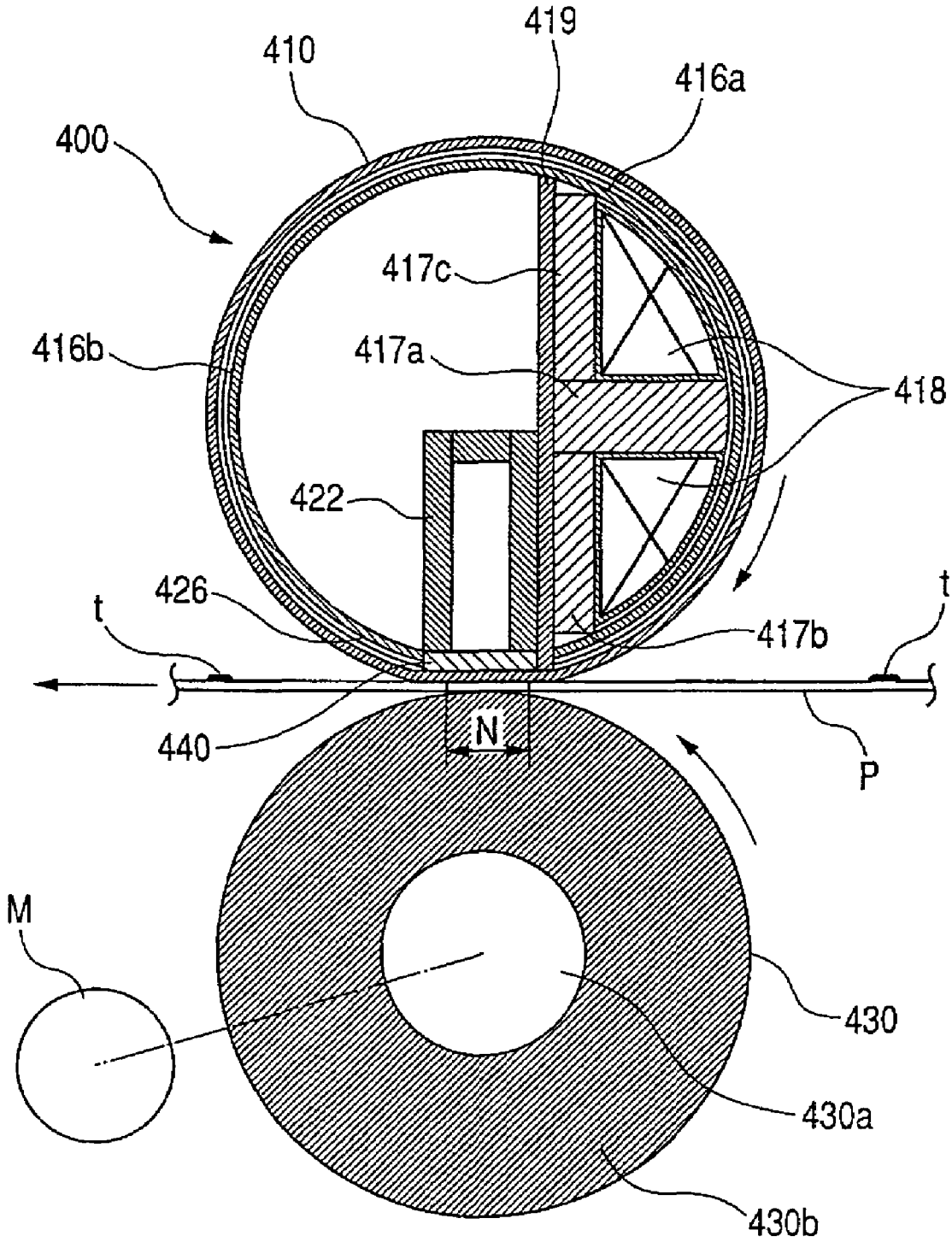
FIG. 4 is a configuration diagram which shows a second embodiment of a heat fixing device of the present invention.

In the case of the heat fixing device of the electromagnetic induction heating type shown in FIG. 4, the thickness of the metal layer 1 is smaller than the skin depth expressed by the following equation, usually not less than 1 μm, preferably not less than 10 μm, but usually not more than 200 μm, preferably not more than 100 μm, more preferably not more than 70 μm.

By using frequency f [Hz] of an exciting circuit, magnetic permeability μ and resistivity ρ[Ωm], skin depth σ[m] is expressed by the following equation:

$$\sigma=503\times(\rho/f\mu)^{1/2}.$$

The skin depth shows the depth of absorption of an electromagnetic wave used in electromagnetic induction. The intensity of an electromagnetic wave at larger depths is not more than 1/e (the letter "e" denotes the base of natural logarithm), and conversely, almost all quantity of energy is absorbed until electromagnetic waves reach this depth. Compared to electroformed nickel, in the electroformed nickel-iron alloy in the present invention, the larger the iron content, the higher the magnetic flux density. However, the resistivity of this electroformed nickel-iron alloy is 2 to 5 times as high as that of electroformed nickel. For this reason, if the electroformed nickel-iron alloy in the present invention is too thin, then it becomes impossible to absorb almost all electromagnetic energy and the efficiency may sometimes become worse. If the magnetic layer 1 is too thick, then the rigidity becomes high and the flexing characteristics become worse, with result that the magnetic layer 1 may sometimes become less easy to use as a rotating body.

<Elastic Layer>

It is not always necessary that the elastic layer 2 be provided. However, providing the elastic layer 2 ensures the transmission of heat by covering an image which is heated in the nip portion and can compensate for the resilience of the metal layer 1 to lessen fatigue by rotation and flexing. Furthermore, the provision of the elastic layer 2 increases the response of the release layer surface of the fixing belt to the surface of an unfixed toner image and it becomes possible to efficiently transmit heat. The fixing belt provided with the elastic layer 2 is especially suitable for the heat fixing of a color image having a larger laid-on amount of unfixed toner thereon.

The material for the elastic layer 2 is not especially limited and materials having good thermal resistance and good thermal conductivity can be selected. As the material for the elastic layer 2, silicone rubber, fluororubber, fluorosilicone rubber and the like are preferable and silicone rubber is especially preferable.

As silicone rubber materials which are used for forming the elastic layer 2, it is possible to mention polydimethylsiloxane, polymethyltrifluoropropylsiloxane, polymethylvinylsiloxane, polytrifluoropropylvinyl-siloxane, polymethylphenylsiloxane, polyphenylvinyl-siloxane, copolymers composed of monomer units of these polysiloxanes and the like.

Incidentally, as required, it is possible that the elastic layer 2 contains reinforcing filling materials, such as dry silica and wet silica, and filling materials, such as calcium carbonate, quartz powder, zirconium silicate, clay (aluminum silicate), talc (hydrous magnesium silicate), alumina (aluminum oxide), iron oxide red (iron oxide).

Because good fixed-image quality is obtained, the thickness of the elastic layer 2 is not less than 10 μm, particularly preferably not less than 50 μm but not more than 1,000 μm, particularly preferably not more than 500 μm. When a color image is printed, a solid image is formed over a large area on a recording material P particularly in the case of a photo image and the like. In this case, if a heated surface (release layer 3) cannot respond to the irregularities of the recording material or the irregularities of the toner layer, unevenness in heating occurs and a nonuniform gloss occurs in portions having a large quantity of heat transfer and those having a small quantity of heat transfer. That is, glossiness increases in portions having a large quantity of heat transfer, and glossiness decreases in portions having a small quantity of heat transfer. If the elastic layer 2 is too thin, the heated surface (release layer 3) cannot respond to the irregularities of the recording material or the toner layer, with the result that a nonuniform gloss may occur in an image. If the elastic layer 2 is too thick, the thermal resistance of the elastic layer increases and it may sometimes become difficult to realize a quick start.

The hardness (JIS-K-6253) of the elastic layer 2 is preferably not more than 60°, more preferably not more than 45° in order to suppress occurrence of nonuniform gloss and obtain good fixed image quality.

The thermal conductivity λ of the elastic layer 2 is preferably not less than $2.5\times10^{-3}$ [W/cm·° C.], more preferably not less than $3.3\times10^{-3}$ [W/cm·° C.]. Also, the thermal conductivity λ of the elastic layer 2 is preferably not more than $8.4\times10^{-3}$ [W/cm·° C.], more preferably not more than $6.3\times10^{-3}$ [W/cm·° C.]. If the thermal conductivity λ is too small, then thermal resistance increases and a temperature rise in the surface layer (release layer 3) of the fixing belt may sometimes lag. If the thermal conductivity λ is too large, then the hardness and compressive permanent strain of the elastic layer 2 may sometimes increase.

The elastic layer 2 can be formed by publicly known methods, for example, a method which involves coating a material, such as liquid silicone rubber and the like, on a metal layer in a uniform thickness by means of a blade coat method and the like and performing curing by heating, a method which involves pouring a material such as liquid silicone rubber into a molding die and performing curing by vulcanization, a method which involves performing curing by vulcanization after extrusion, and a method which involves curing by vulcanization after injection molding.

<Release Layer>

Materials for the release layer 3 are not especially limited, and it is possible to select materials having good mold release characteristics and heat resistance. As materials for the release layer 3, fluororesins, such as PFA (tetrafluoroethylene/perfluoroalkylether copolymer), PTFE (polytetrafluoroethylene), FEP (tertafluoroethylene/hexafluoropropylene copolymer), silicone resins, fluorosilicone rubber, fluororubber, silicone rubber and the like are preferable, and PFA is more preferable. Incidentally, as required, electrically conductive agents such as carbon and tin oxide may be contained in the release layer. Although the contents of the electrically conductive agents are not especially limited, in general, it is preferred that the electrically conductive agents be contained in amounts of not more than 10 mass % of the total mass of materials constituting the release layer.

It is preferred that the thickness of the release layer 3 be not less than 1 μm but not more than 100 μm. If the release layer 3 is too thin, due to an uneven thickness of the release layer 3, bad portions in mold release characteristics may sometimes be formed and insufficient endurance may sometimes occur. If the release layer 3 is too thick, thermal conductivity may sometimes worsen, and particularly in the case of a resin-based release layer, due to high hardness, the effect of the elastic layer 2 may sometimes be lost.

Such release layers can be formed by publicly known methods. For example, a fluororesin-based release layer is formed by a method which involves dispersing a fluororesin powder to make a paint, coating with this paint, and drying and baking the coat or by a method which involves coating and bonding with a material which is made in the form of a tube beforehand. A rubber-based release layer is formed by a method which involves pouring a liquid material into a molding die and performing curing by vulcanization, a method which involves curing by vulcanization after extrusion, a method which involves curing by vulcanization after injection molding, etc.

Also, it is possible to adopt a method by which a tube the inner surface of which is subjected to primer treatment beforehand and an endless electroformed nickel-iron alloy belt the inner surface of which is subjected to primer treatment beforehand are mounted within a cylindrical mother mold, liquid silicone rubber is poured into the gap between this tube and the endless electroformed nickel-iron alloy belt, the silicone rubber is cured by heating, and the silicon rubber is bonded, whereby the elastic layer and the release layer are simultaneously formed.

(2) Heat Fixing Device

Next, the heat fixing device of the present invention will be described. The heat fixing device of the present invention has a fixing belt and a pair of pressure contact members which are in pressure contact with each other via the fixing belt. The inner surface of the fixing belt slides with one of the pair of pressure contact members, the heat fixing device thermally fixes an unfixed toner image on a recording material by heat from the fixing belt, and the fixing belt used is the above-described fixing belt.

FIRST EMBODIMENT

In a fixing device of the belt heating type in which a ceramics heater is used as a heating body, the fixing belt of the present invention can be favorably used.

FIG. 3 is a schematic figure showing the cross section of a heat fixing device 300 in an embodiment of the present invention. In this embodiment, the heat fixing device 300 is a fixing device of the belt heating type in which a ceramics heater is used as a heating body, and a fixing belt 310 is the fixing belt of the present invention.

A belt guide 316 is a belt guide having heat resistance and heat insulating properties. A ceramics heater 312 as a heating body is inserted into a groove formed in a substantially middle part of the bottom surface of the belt guide 316 along the longitudinal direction of the guide, and fixed to the groove and supported by the groove. And the fixing belt 310 of the present invention, which is cylindrical or endless, is fitted into the belt guide 316 in a loose manner.

A rigid stay for pressurization 322 is inserted into the inner side of the guide 316.

In this embodiment, a pressurizing member 330 is a pressure roller having an elastic layer. In this pressurizing member 330, an elastic layer 330*b* of silicone rubber or the like is provided in a peripheral part of a core metal 330*a*. Both ends of the core metal 330*a* are freely rotatably supported by bearing between chassis side plates on the front side and back side of the device, which are not shown. In order to improve surface properties, the pressure roller having an elastic layer may further be provided, at the periphery of this elastic layer, with a release layer made of fluororesins, such as PTFE (polytetrafluoroethylene), PFA (tertafluoroethylene/perfluoroalkylether copolymer), FEP (tertafluoroethylene/hexafluoropropylene copolymer).

A pressure spring (not shown) is provided in a compressive manner each between both ends of the stay for pressurization 322 and a spring receiving member (not shown) on the chassis side of the device and this pressure spring is caused to exert a depressing force on the stay for pressurization 322. As a result of this, the bottom surface of a sliding plate 340 disposed on the bottom surface of the ceramics heater 312 and the top surface of the pressure roller 330 are brought into pressure contact via the fixing belt 310, whereby a nip portion N having a specified width is formed.

As materials for fabricating the belt guide 316, resins excellent in heat resistance, such as heat resistant phenol resins, LCP (liquid crystal polyester) resins, PPS (polyphenylene sulfide) resins and PEEK (polyether-ether ketone) resins are favorably used.

The pressure roller 330 is rotatably driven by driving means (not shown) counterclockwise as indicted by an arrow. Due to the friction of the pressure roller 330 with the outer surface of the fixing belt 310 caused by the rotational driving of this pressure roller 330, a rotational force acts on the fixing belt 310. With the inner surface of the fixing belt 310 in the nip N portion sliding in close contact with the bottom surface of the ceramics heater 312, the fixing belt 310 rotates at the outer surface of the belt guide 316 at a peripheral speed which corresponds substantially to the rotational peripheral speed of the pressure roller 330 clockwise as indicated by an arrow (the pressure roller driving system).

On the basis of a print start signal the rotation of the pressure roller 330 is started and the heat-up of the ceramic heater 312 is started. When the rotational peripheral speed of the fixing belt 310 by the rotation of the pressure roller 330 has become steady and the temperature of the ceramics heater 312 has risen to a prescribed temperature, a recording material P on which an unfixed toner image t to be fixed as a material to be heated is carried is introduced between the fixing belt 310 of the nip portion N and the pressure roller 330, with the toner image carrying surface side facing the fixing belt 310 side. And the recording material P comes into close contact with the bottom surface of the ceramics heater 312 via the fixing belt 310 in the nip portion N, and the recording material P, along with the fixing belt 310, moves and passes through the nip portion N. In this moving and passing process, the heat of the ceramics heater 312 is given to the recording material P via the fixing belt 310, whereby the unfixed toner image t to be fixed is thermally fixed to the surface of the recording material P. The recording material P which has passed through the nip portion N is separated from the outer surface of the fixing belt 310 and transferred.

The ceramics heater 312 as a heating body is a horizontally long, linear heating body of low heat capacity which has a direction orthogonal to the moving direction of the fixing belt 310 and recording material P as a longitudinal direction. The ceramics heater 312 is basically constituted by a heater substrate made of aluminum nitride or the like, a heat generating layer 312*b* which is provided on the surface of this heater substrate along the longitudinal direction thereof, which is a heat generating layer 312*b* in which an electric resistance material of Ag/Pd (silver/palladium), for example, is provided in a thickness of about 10 μm and a width of 1 to 5 mm by screen printing and the like, and a protective layer 312*c* of glass, fluororesin and the like which is further provided on top of this heat generating layer 312*b*. Incidentally, the ceramics heater to be used is not limited to this ceramic heater.

Energizing across both ends of the heat generating layer 312*b* of the ceramics heater 312 causes the heat generating layer 312*b* to generate heat, and the temperature of the heater 312 rises abruptly. The heater temperature is detected by a temperature sensor (not shown), and the energizing of the heat generating layer 312*b* is controlled by a control circuit (not shown) so that the heater temperature is maintained at a prescribed temperature, whereby the ceramics heater 312 is controlled in temperature.

The ceramics heater 312 is inserted into a groove formed in a substantially middle part of the bottom surface of the belt guide 316 along the longitudinal direction of the guide, and fixed to the groove and supported by the groove, with the protective layer 312*c* side facing upward. In the nip portion N which comes into contact with the fixing belt 310, the surface of the sliding plate 340 of this ceramics heater 312 and the inner surface of the fixing belt 310 mutually come into contact and slide.

It is also possible to provide a ferromagnetic metal plate, such as iron plate, in place of the ceramics heater, to cause the ferromagnetic metal plate to generate heat by the electromagnetic induction which is used in the second embodiment, and to use this ferromagnetic metal plate as a heater.

The pressurizing member 330 is not limited to pressurizing members having the shape of a roller, such as the pressure roller, and it is possible to adopt members of other shapes such as the rotary film type. In order to supply heat energy to the recording material P also from the pressurizing member 330 side, it is also possible to adopt an equipment configuration in which on the pressurizing member 330 side also, heat generating means of the electromagnetic induction heating type and the like is provided, heating to a prescribed temperature is performed and temperature adjustment is performed.

SECOND EMBODIMENT

FIG. 4 is a schematic diagram which shows the cross section of an essential part of a heat fixing device 400 in another embodiment of the present invention. The heat fixing device 400 of this embodiment is a device of the electromagnetic induction heating type, and a fixing belt 410 is the above-described fixing belt of the present invention.

Magnetic field generating means is constituted by magnetic cores 417*a*, 417*b* and 417*c* and an exciting coil 418.

Figure 5:
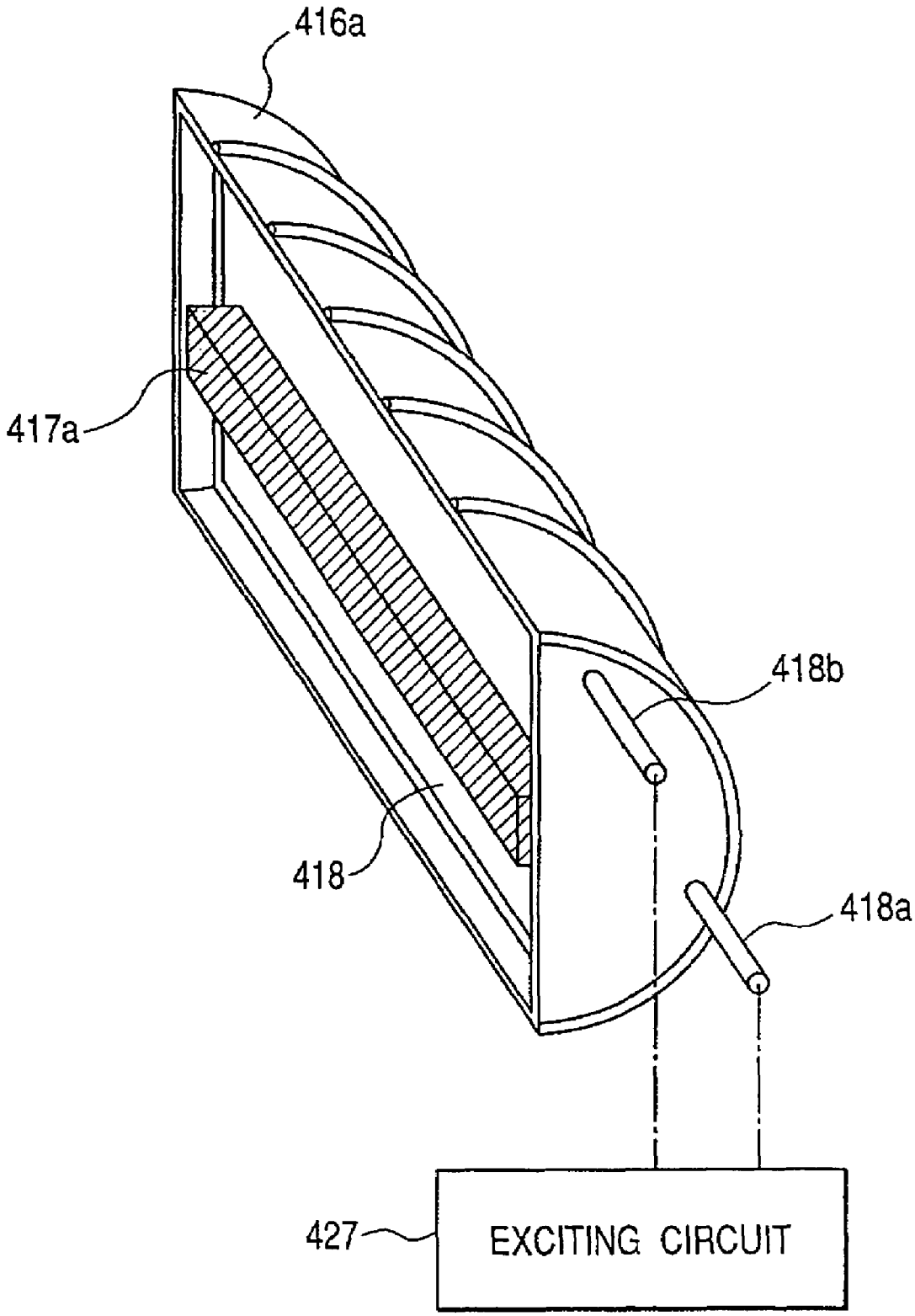
FIG. 5 is a schematic diagram of magnetic field generating means used in the second embodiment of a heat fixing device of the present invention.

FIG. 5 is a schematic view of the magnetic field generating means of this heat fixing device.

The magnetic cores 417*a*, 417*b* and 417*c* are members of high magnetic permeability. Materials used in cores of transformers, such as ferrite and permalloy, are preferable and it is particularly preferred that ferrite which has small losses even at not less than 100 kHz be used.

For the exciting coil 418, a conductor (an electric wire) which constitutes the coil is fabricated by bundling multiple fine wires made of copper each of which is covered with an insulating coating, and bundled fine wires are wound several turns. In this embodiment, the exciting coil 418 is formed by winding bundled fine wires 11 turns.

In consideration of thermal conduction by the heat generation of the fixing belt 410, it is preferred that a coating having heat resistance be used as the insulating coating. For example, it is preferred that fine wires coated with polyimide resin and the like be used. The density of the exciting coil 418 may be increased by applying pressure from the outside of the coil.

An insulating member 419 is disposed between the magnetic field generating means and the fixing belt 410. As materials for the insulating member 419, those which are excellent in insulating properties and heat resistance are preferable. For example, phenol resins, fluororesins, polyimide resins, polyamide resins, polyamideimide resins, PEEK (polyether-ether ketone) resins, PES (polyethersulfone) resins, PPS (polyphenylene sulfide) resins, PFA (tertafluoroethylene/perfluoroalkylether copolymer) resins, PTFE (polytetrafluoroethylene) resins, FEP (tetrafluoroethylene/hexafluoropropylene copolymer) resins, LCP (liquid crystal polyester) resins and the like are favorably mentioned.

In the exciting coil 418, an exciting circuit 427 (FIG. 5) is connected to power feed portions 418*a*, 418*b*. It is preferred that an exciting circuit capable of generating high frequency waves of, preferably, 20 kHz to 500 kHz by use of a switching power source be used as this exciting circuit 427. The exciting coil 418 generates an alternating magnetic flux by an alternating current (a high frequency current) supplied from the exciting circuit 427.

The alternating magnetic flux (C) introduced into the magnetic cores 417*a* to 417*c* generates an eddy current in a metal layer 1 (an electromagnetic induction heat generating layer) formed from a nickel-iron alloy of the fixing belt 410. This eddy current generates the Joule heat (an eddy current loss) in the metal layer 1 (the electromagnetic induction heat generating layer) by the resistivity of the metal layer 1 (the electromagnetic induction heat generating layer). The calorific value Q here is determined by the density of magnetic fluxes which pass through the magnetic layer 1 (the electromagnetic induction heat generating layer). By controlling current supply to the exciting coil 418 by use of a temperature adjusting system including temperature detecting means (not shown), the temperature of the nip portion N is adjusted so that a prescribed temperature is maintained. In the embodiment shown in FIG. 4, a temperature sensor 426 is a thermistor which detects the temperature of the fixing belt 410 and the like, and controls the temperature of the nip portion N on the basis of the temperature information of the fixing belt 410, which is measured by the temperature sensor 426.

A pressure roller 430 as a pressurizing member is constituted by a core metal 430*a*, and a heat resistant elastic layer 430*b* of, for example, silicone rubber, fluororubber, fluorosilicone rubber and the like, which is formed in roller shape concentrically and integrally in the peripheral part of the core metal to cover the core metal. The pressure roller 430 is disposed in such a manner that both ends of the core metal 430*a* are freely rotatably supported by bearing between chassis side plates, which are not shown.

A pressure spring (not shown) is provided in a compressive manner each between both ends of the rigid stay for pressurization 422 and a spring receiving member (not shown) on the chassis side of the device and this pressure spring is caused to exert a depressing force on the rigid stay for pressurization 422. As a result of this, the bottom surface of a sliding plate 440 disposed on the bottom surface of the belt guide 416*a* and the top surface of the pressure roller 430 are brought into pressure contact via the fixing belt 410, whereby a nip portion N having a specified width is formed. Incidentally, as materials for the fabrication of the belt guide 416, it is preferable to use resins excellent in heat resistance, such as heat resistant phenol resins, LCP (liquid crystal polyester) resins, PPS (polyphenylene sulfide) resins, and PEEK (polyether-ether ketone) resins.

The pressure roller 430 is rotatably driven by driving means M counterclockwise as indicted by an arrow. Due to the friction of the pressure roller 430 with the fixing belt 410 caused by the rotational driving of this pressure roller 430, a rotational force acts on the fixing belt 410. With the inner surface of the fixing belt 410 in the nip N portion sliding with the bottom surface of the sliding plate 440, the fixing belt 410 rotates around the outer surface of the belt guide 416 (416*a* and 416*b*) at a peripheral speed which corresponds substantially to the rotational peripheral speed of the pressure roller 430 clockwise as indicated by an arrow.

The pressure roller 430 is rotatably driven in this manner, and as a result of this, the fixing belt 410 rotates. By the power feed from the exciting circuit 427 to the exciting coil 418, the electromagnetic induction heat generation of the fixing belt 410 is performed as described above. With the temperature of the nip portion N risen to a prescribed temperature and temperature-adjusted, a recording material P, on which an unfixed toner image t transferred from an image forming means part is formed, is introduced between the fixing belt 410 and the pressure roller 430 in the nip portion N with the image surface facing upward, that is, the image surface being opposed to the fixing belt surface. In the nip portion N, the image surface is brought into close contact with the external surface of the fixing belt 410 and the image is sandwiched and transferred together with the fixing belt 410. In this process, by being heated by the electromagnetic wave induction heat generation of the fixing belt 410, the unfixed toner image t is thermally fixed to the surface of the recording material P. After passing through the nip portion N, the recording material P is separated from the outer surface of the fixing belt 410, discharged and transferred.

After passing through the nip portion N, the heated and fixed toner image on the recording material is cooled and becomes a permanently fixed image. Although in this embodiment the heat fixing device is not provided with an oil application mechanism to prevent offsets, an oil application mechanism may be provided in a case where a toner which does not contain low softening substances is used. Also in a case where a toner which contains low softening substances is used, it is possible to separate the recording material P by performing oil application and cooling and to discharge and transport the recording material P.

The pressurizing member 430 is not limited to pressurizing members having the roller shape, such as the pressure roller, and it is possible to adopt members of other shapes such as the rotary film type. In order to supply heat energy to the material to be recorded also from the pressurizing member 430 side, it is also possible to adopt a device configuration in which on the pressurizing member 430 side also, heat generating means of the electromagnetic induction heating type and the like is provided, heating to a prescribed temperature is performed and temperature adjustment is performed.

OTHER EMBODIMENTS

Figure 6:
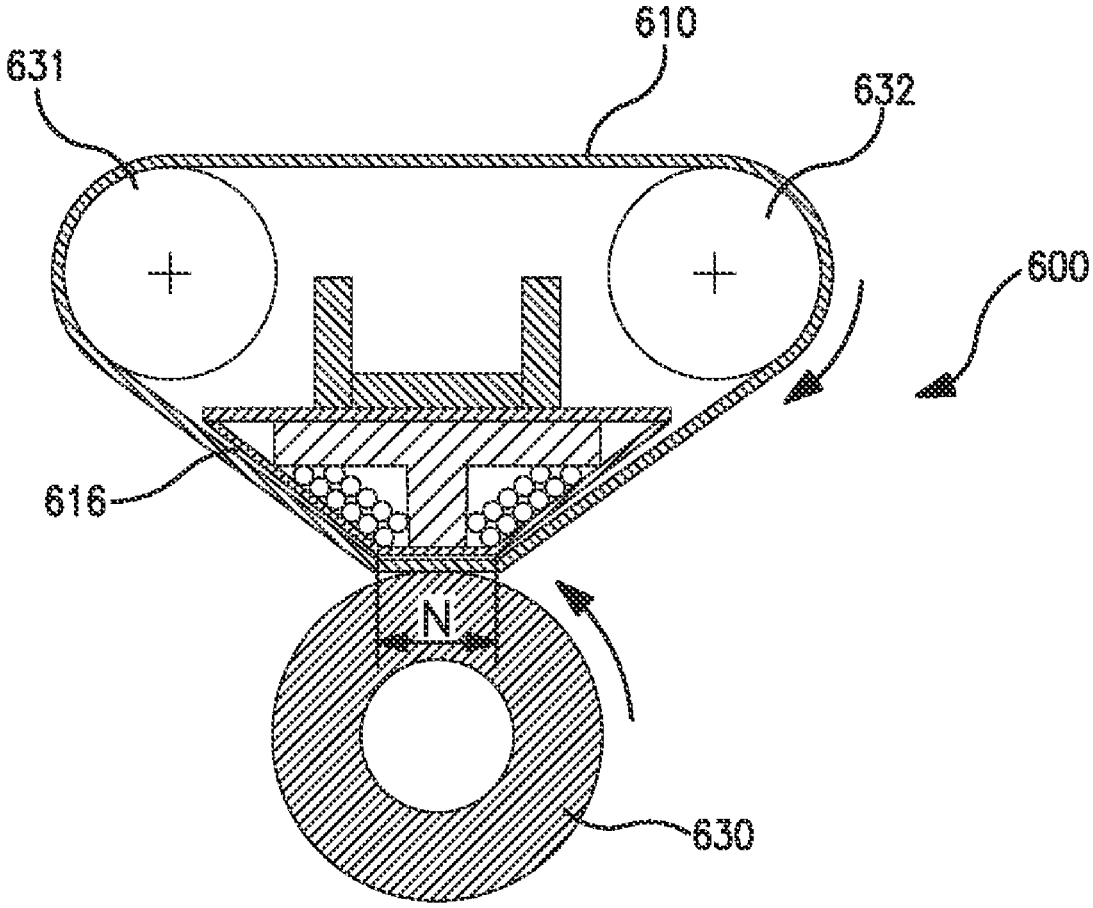
FIG. 6 is a configuration diagram which shows a further embodiment of a heat fixing device of the present invention.

The equipment makeup of a heat fixing device is not limited to the pressure roll driving type as in the above-described embodiments. In addition to this type, it is possible to adopt an equipment makeup as in a heat fixing device 600 shown in FIG. 6, for example. In this heat fixing device 600, a fixing belt 610 of the present invention is fitted over and around a belt guide 616, a driving roller 631 and a tension roller 632, and the bottom surface of the belt guide 616 and a pressure roller 630 as a pressurizing member are brought into pressure contact with each other via the fixing belt 610 to form a nip portion N, whereby the fixing belt 610 is rotatably driven by the driving roller 631. In this case, the pressure roller 630 is a driven rotating roller.

Also in this case, the pressurizing member 630 is not limited to a pressurizing member having the shape of a roller and it is possible to adopt a pressurizing member of other types, such as the rotary film type. In order to supply heat energy to the recording material also from the pressurizing member 630 side, it is also possible to adopt an equipment makeup in which on the pressurizing member 630 side also, heat generating means of the electromagnetic induction heating type and the like is provided, heating to a prescribed temperature is performed and temperature adjustment is performed.

EMBODIMENTS

The present invention will be described below in further detail by using embodiments.

The measurement of the carbon, iron and sulfur contents of a nickel-iron alloy of an endless metal belt and the measurement of the hardness of the endless metal belt in the embodiments and comparative examples, as well as an idling endurance test and an actual-device endurance paper-feed test in the embodiments and comparative examples were carried out as shown below.

<Measurement of Carbon, Sulfur and Iron Contents of Nickel-Iron Alloy>

The iron content of a nickel-iron alloy was measured by us of a fluorescent X-ray analyzer made by Rigaku Corporation, Type RIX3000 (trade name). The sulfur and carbon contents were measured by use of a measuring instrument made by LECO Corporation U.S.A., Type CS-444 (trade name) by the combustion infrared absorption method.

<Measurement of Hardness of Nickel-Iron Alloy>

Vickers hardness (load: 100 g) was measured on the basis of JIS Z2244 by use of a measuring device made by Akashi Corporation, HM123 (trade name).

<Idling Endurance Test>

(Idling Endurance Test by Heat Fixing Device of Belt Heating Type of Heater Heating Method)

A heat fixing device (unit) of the belt heating type of the heater heating method to which a fixing belt of the embodiments or the comparative examples is attached was mounted on a full-color LBP made by Canon Inc., LASER SHOT LBP-2040 (trade name) as a heat fixing device, and an idling endurance test was conducted by using this test apparatus as follows.

The pressure roller was pushed against the fixing belt under a prescribed pressure load while the heater temperature of the heat fixing device was being adjusted to 210° C., and the fixing belt was driven and rotated by the pressure roller. A pressure roller having a diameter of 16 mm in which a 3-mm thick elastic layer made of silicone rubber is covered with a 30-μm PFA tube was used as the pressure roller. For the conditions of this idling endurance test, the pressure load was 200 N, the nip portion has a width of 6 mm and a length of 230 mm, and the surface speed of the fixing belt was 87 mm/s. In the test, 0.5 g of a lubricant (trade name: HP3000, made by Dow Corning Corporation) was applied to the sliding plate of the belt guide (340 in FIG. 3) in order to improve slippage. In this idling endurance test, the negative torque of the pressure roller required by the driving and rotation of the fixing belt was also measured.

In this idling endurance test, the time which lapses until the cracking and breakage of the fixing belt was measured both visually and under a microscope and regarded as endurance time.

The required minimum endurance time of a fixing belt calculated from a process speed and safety factor of a heat fixing device is 500 hours. However, the endurance life (endurance time) of a fixing belt of the present invention was set at not less than 700 hours, and for belts whose endurance time exceeds 700 hours, the test was finished when the endurance time exceeded 700 hours.

(Idling Endurance Test by Heat Fixing Device of Belt Heating Type of Electromagnetic Induction Heating Method)

A heat fixing device (unit) of the belt heating type of the electromagnetic induction heating method to which a fixing belt of the embodiments or the comparative examples is attached was mounted on a full-color LBP made by Canon Inc., LASER SHOT LBP-2710 (trade name) as a heat fixing device, and an idling endurance test was performed by using this test apparatus as follows.

The pressure roller was pushed against the fixing belt under a prescribed pressure load while the heater temperature of the heat fixing device was being adjusted to 220° C., and the fixing belt was driven and rotated by the pressure roller. A rubber roller with a diameter of 30 mm in which a 3-mm thick silicone layer is covered with a 30-μm PFA tube was used as the pressure roller. For the conditions of this idling endurance test, the pressure load was 200 N, the fixing nip portion has a width of 7 mm and a length of 230 mm, and the surface speed of the fixing belt was 120 mm/s, which is a high printing speed. In the test, 0.5 g of a lubricant (trade name: HP3000, made by Dow Corning Corporation) was applied to the sliding plate of the belt guide (440 in FIG. 4) in order to improve slippage.

<Actual-Device Endurance Paper-Feed Test>

By use of the full-color LBPs made by Canon Inc., LASER SHOT LBP-2040 (trade name) and LASER SHOT LBP-2710 (trade name) on which the heat fixing device (unit) used in the above-described idling endurance tests is mounted, 100,000 images were outputted and an actual-device endurance paper-feed test was conducted under the same use conditions as the above-described idling endurance tests.

FIRST TO TWENTY-FIRST EMBODIMENTS AND COMPARATIVE EXAMPLES 1 TO 4

<Fabrication and Evaluation of Endless Metal Belts>

A nickel-iron alloy plating bath which contains nickel sulfate, ferrous sulfate, boric acid, sodium chloride, saccharin sodium, butyne diol and sodium lauryl sulfate was prepared. A mother mould made of stainless steel was immersed as a cathode in this plating bath, the nickel-iron alloy was electrodeposited at a bath temperature of 40° C. and a current density of 2 to 14 A/dm$^2$ for 13 to 90 minutes, the electrodeposited film was then removed from the mother mold, and an endless metal belt having an inside diameter of ϕ 24 mm, a thickness of 30 μm and a length of 250 mm was prepared.

The fabrication conditions of the above-described endless metal belt is shown in Table 1.

TABLE 1

| | Bath composition | | | | | | | Process conditions | |
|---|---|---|---|---|---|---|---|---|---|
| | | | Sodium | | | | | | |
| | Nickel sulfate g/l | Boric acid g/l | Sodium chloride g/l | lauryl sulfate g/l | Ferrous sulfate g/l | Saccharin sodium g/l | Butyne diol g/l | Current density A/dm$^2$ | Electrodeposition time min |
| 1st Embodiment | 130 | 25 | 23 | 0.02 | 2.0 | 0.05 | 0 | 2 | 90 |
| 2nd Embodiment | 130 | 25 | 23 | 0.02 | 2.6 | 0.06 | 0 | 2 | 90 |
| 3rd Embodiment | 130 | 25 | 23 | 0.02 | 3.1 | 0.07 | 0 | 2 | 90 |
| 4th Embodiment | 130 | 25 | 23 | 0.02 | 3.6 | 0.08 | 0 | 2 | 90 |
| 5th Embodiment | 130 | 25 | 23 | 0.02 | 2.0 | 0.05 | 0 | 4 | 45 |
| 6th Embodiment | 130 | 25 | 23 | 0.02 | 2.6 | 0.06 | 0 | 4 | 45 |
| 7th Embodiment | 130 | 25 | 23 | 0.02 | 3.1 | 0.07 | 0 | 4 | 45 |
| 8th Embodiment | 130 | 25 | 23 | 0.02 | 3.6 | 0.08 | 0 | 4 | 45 |
| 9th Embodiment | 130 | 25 | 23 | 0.02 | 2.0 | 0.05 | 0 | 6 | 30 |
| 10th Embodiment | 130 | 25 | 23 | 0.02 | 2.6 | 0.06 | 0 | 6 | 30 |
| 11th Embodiment | 130 | 25 | 23 | 0.02 | 3.1 | 0.07 | 0 | 6 | 30 |
| 12th Embodiment | 130 | 25 | 23 | 0.02 | 3.6 | 0.08 | 0 | 6 | 30 |
| 13th Embodiment | 130 | 25 | 23 | 0.02 | 2.6 | 0.10 | 0 | 8 | 23 |
| 14th Embodiment | 130 | 25 | 23 | 0.02 | 3.1 | 0.11 | 0 | 8 | 23 |
| 15th Embodiment | 130 | 25 | 23 | 0.02 | 3.6 | 1.9 | 0 | 10 | 18 |
| 16th Embodiment | 130 | 25 | 23 | 0.02 | 4.7 | 2.0 | 0 | 12 | 15 |
| 17th Embodiment | 130 | 25 | 23 | 0.02 | 6.0 | 2.0 | 0 | 14 | 13 |
| 18th Embodiment | 130 | 25 | 23 | 0.02 | 1.0 | 0.03 | 0 | 4 | 45 |
| 19th Embodiment | 130 | 25 | 23 | 0.02 | 2.0 | 0.03 | 0 | 4 | 45 |
| 20th Embodiment | 130 | 25 | 23 | 0.02 | 1.0 | 0.03 | 0.30 | 4 | 45 |
| 21st Embodiment | 130 | 25 | 23 | 0.02 | 13 | 2.5 | 22 | 10 | 18 |
| Com. Ex. 1 | 130 | 25 | 23 | 0.02 | 0.15 | 0.03 | 0 | 4 | 45 |
| Com. Ex. 2 | 130 | 25 | 23 | 0.02 | 0.94 | 2.0 | 0 | 4 | 45 |
| Com. Ex. 3 | 130 | 25 | 23 | 0.02 | 6.0 | 3.5 | 0 | 14 | 13 |
| Com. Ex. 4 | 130 | 25 | 23 | 0.02 | 0.94 | 0.03 | 0.6 | 4 | 45 |

The iron, sulfur and carbon contents of the obtained endless metal belt made of a nickel-iron alloy were measured.

In a case where the release layer 3 is formed by dispersing powders of PFA, FEP and the like to make a paint, coating with this paint, and drying and baking the coat, heating may sometimes performed at temperatures of 320 to 330° C. or so. In the case of an endless metal belt of a nickel-iron alloy which is fabricated by the electroforming process, hardness increases when heating is performed, and when further heated, some of such endless metal belts show a decrease in hardness at 300° C. or so and some of them show an increase in hardness at 300° C. or so. Those which show a decrease in hardness become brittle and apt to be cracked. Therefore, in order to judge the heat resistance of obtained endless metal belts, they were subjected to heating treatment at 320° C. and 330° C. for 30 minutes, and the hardness of the endless metal belts after the heating treatment was measured.

<Fabrication and Evaluation of Endless Metal Belts>

After a primer was caused to be contained in a sponge, a primer layer was formed by applying the primer to the external peripheral surface of each of the obtained endless metal belt. Next, a primer layer was similarly formed on the inner surface of a PFA tube, the PFA tube, along with the above-described endless metal belt was mounted coaxially in a cylindrical metal mold having almost the same inside diameter, liquid silicone rubber, DY32-561A/B (trade name, made by TORAY DOW CORNING SILICONE Co., Limited) was poured between the PFA tube and the endless metal belt, heated at 200° C. for 30 minutes in a hot blast circulating drying furnace and each layer was simultaneously cured, whereby an elastic layer constituted of silicone rubber having a thickness of 300 μm and a release layer constituted of PFA tube having a thickness of 30 μm, which is provided in the peripheral part of the elastic layer via an adhesive layer, were simultaneously formed and a fixing belt was thus obtained.

The above-described idling endurance test and actual-device endurance paper-feed test were conducted on the obtained fixing belts.

Table 2 shows the results of the idling endurance test by the heat fixing device of the belt heating type of the heater heating method, measurement results of the iron, sulfur and carbon contents of the nickel-iron alloy of the endless metal belts, and measured values of hardness of the endless metal belts subjected to heating treatment.

TABLE 2

| | Content | | | | | Hardness | | | | |
|---|---|---|---|---|---|---|---|---|---|---|
| | Sulfur S (mass %) | Iron F (mass %) | Carbon C (mass %) | F/S | C/S | 320° C. ° | 330° C. ° | ΔH (320–330) ° | Endurance time h | Others |
| 1st Embodiment | 0.060 | 10 | 0.006 | 167 | 0.103 | 530 | 520 | 10 | Stopped in 700 h. | |
| 2nd Embodiment | 0.055 | 12 | 0.006 | 218 | 0.107 | 560 | 550 | 10 | Stopped in 700 h. | |
| 3rd Embodiment | 0.050 | 14 | 0.006 | 280 | 0.120 | 590 | 580 | 10 | Stopped in 700 h. | |
| 4th Embodiment | 0.040 | 17 | 0.004 | 425 | 0.110 | 615 | 600 | 15 | Stopped in 700 h. | |
| 5th Embodiment | 0.070 | 9 | 0.007 | 129 | 0.094 | 520 | 500 | 20 | Stopped in 700 h. | |
| 6th Embodiment | 0.050 | 12 | 0.005 | 240 | 0.106 | 570 | 550 | 20 | Stopped in 700 h. | |
| 7th Embodiment | 0.055 | 14 | 0.005 | 255 | 0.098 | 590 | 580 | 10 | Stopped in 700 h. | |
| 8th Embodiment | 0.048 | 17 | 0.005 | 354 | 0.104 | 610 | 600 | 10 | Stopped in 700 h. | |
| 9th Embodiment | 0.070 | 9 | 0.007 | 129 | 0.106 | 530 | 520 | 10 | Stopped in 700 h. | |
| 10th Embodiment | 0.068 | 12 | 0.007 | 176 | 0.100 | 570 | 560 | 10 | Stopped in 700 h. | |
| 11th Embodiment | 0.055 | 14 | 0.005 | 255 | 0.098 | 580 | 560 | 20 | Stopped in 700 h. | |
| 12th Embodiment | 0.048 | 17 | 0.005 | 354 | 0.104 | 605 | 600 | 5 | Stopped in 700 h. | |
| 13th Embodiment | 0.080 | 12 | 0.009 | 150 | 0.113 | 570 | 560 | 10 | Stopped in 700 h. | |
| 14th Embodiment | 0.075 | 14 | 0.007 | 187 | 0.095 | 590 | 570 | 20 | Stopped in 700 h. | |
| 15th Embodiment | 0.085 | 16 | 0.006 | 188 | 0.071 | 610 | 590 | 20 | Stopped in 700 h. | |
| 16th Embodiment | 0.090 | 20 | 0.007 | 222 | 0.078 | 640 | 630 | 10 | Stopped in 700 h. | |
| 17th Embodiment | 0.090 | 25 | 0.008 | 278 | 0.089 | 670 | 650 | 20 | Stopped in 700 h. | |
| 18th Embodiment | 0.035 | 6 | 0.004 | 171 | 0.114 | 480 | 460 | 20 | Stopped in 700 h. | |
| 19th Embodiment | 0.020 | 10 | 0.005 | 500 | 0.250 | 490 | 470 | 20 | Stopped in 700 h. | |
| 20th Embodiment | 0.030 | 6 | 0.058 | 200 | 1.933 | 480 | 470 | 10 | Stopped in 700 h. | |
| 21st Embodiment | 0.090 | 25 | 0.098 | 278 | 1.089 | 670 | 660 | 10 | Stopped in 700 h. | |
| Com. Ex. 1 | 0.030 | 1 | 0.004 | 33 | 0.133 | 460 | 380 | 80 | 150 | |
| Com. Ex. 2 | 0.140 | 3 | 0.004 | 21 | 0.029 | 550 | 450 | 100 | 90 | |
| Com. Ex. 3 | 0.141 | 10 | 0.009 | 71 | 0.064 | 690 | 590 | 100 | 80 | |
| Com. Ex. 4 | 0.040 | 3 | 0.110 | 75 | 2.750 | 520 | 440 | 80 | 90 | |

For the fixing belts of first to twenty-first Embodiments, the endurance time of the heat fixing device of the belt heating type of the heater heating method exceeded 500 hours, which value is specified for endurance time. In all of these fixing belts, the endurance time exceeded 700 hours. In contrast to this, in the fixing belt of Comparative Example 1, the iron content F (mass %) of which is 1 mass %, the inner surface of the belt was scraped off and this resulted in an increase in the rotary torque of the pressure roller. Therefore, the test was stopped in 150 hours. In the fixing belts of Comparative Examples 2 and 3, in which the sulfur content S (mass %) exceeds 0.13 mass %, cracks occurred in the center part of the metal layer in 90 hours and 80 hours, respectively. In the fixing belt of Comparative Example 4, cracks and fissures were formed in the center part of the metal layer in 90 hours. Although in this fixing belt, the metal layer is made of an nickel-iron alloy having a sulfur content S of 0.040 mass % and an iron content F of 3 mass %, the iron content F (mass %) had a value smaller than (85×S+3)(=6.4 mass %).

In the case of the nickel-iron alloy of the endless metal belt used in the fabrication of the fixing belts of Comparative Examples 1 to 4, a hardness difference between endless metal belts subjected to heat treatment at 320° C. and those subjected to heat treatment at 330° C. (which may sometimes be represented as ΔH (320-330), is 80 to 100, and compared to the nickel-iron alloy of the endless metal belts used in the fabrication of the fixing belts of the embodiments, a decrease in hardness when the heat treatment temperature was raised was very large. Thus, it became apparent that the endless metal belts made of these nickel-iron alloys have too low heat resistance to be used in the fabrication of the fixing belts of the present invention.

Figure 7:
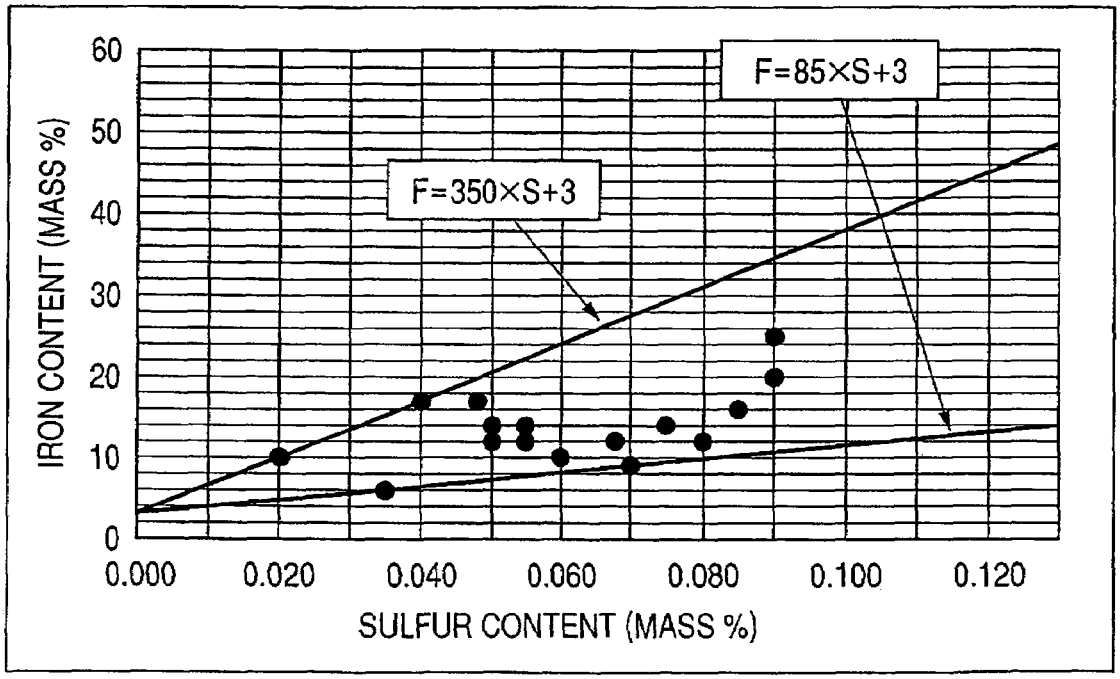
FIG. 7 is a graph in which the iron content and sulfur content of a nickel-iron alloy of an endless metal belt in this embodiment are plotted.

For the iron content F (mass %) and sulfur content S (mass %) of nickel-iron alloys made by the electroforming process in first to twenty-first Embodiments, FIG. 7 shows the results of plotting with the iron content F taken as ordinate and the sulfur content S as abscissa.

As shown in FIG. 7, all of the nickel-alloy alloys that constitute the metal layers of the fixing belts of first to twenty-first Embodiments satisfy the relationships of Equations (1) and (2) above. And it is apparent that when these relationships are satisfied, the heat resistance of the metal layers increases as shown in Table 2, and that the hardness difference ΔH (320-330) is small between endless metal belts subjected to heat treatment at 320° C. and those subjected to heat treatment at 330° C.

In twentieth and twenty-first Embodiments in which butyne diol is added and the carbon content is raised, the endurance time exceeded 700 hours in the idling endurance test. Also, ΔH (320-330) is small and not more than 20. Thus, it became apparent that heat resistance is high.

On the other hand, when the carbon content increased and exceeded twice the sulfur content as in Comparative Example 4, fissures were formed in the center part of the electroformed nickel-iron alloy base material in 90 hours in the idling endurance test. From the ratio of the carbon content C mass % to the sulfur content F mass % in first to twenty-first Embodiments, it became apparent that it is preferred that the carbon content be 0.07 to 2 times the sulfur content.

In the actual-device endurance paper-feed test (a heat fixing device of the heater heating type is mounted), in the case of the mounting of the fixing belts of first to twenty-first Embodiments, 100,000 images were outputted without a trouble and the endurance test was finished. On the other hand, in the case of the mounting of the fixing belts of Comparative Examples 1 to 4, irregularities occurred in images with not more than 10,000 sheets and paper-feed itself became impossible in the course of time.

In the idling endurance test by a heat fixing device of the belt heating type of the electromagnetic induction heating method, in the case of the mounting of the fixing belts of first to twenty-first Embodiments, the endurance time exceeds 700 hours and it was ascertained that the heat resistance and endurance are sufficient. On the other hand, in the fixing belts of Comparative Examples 1 to 4, the endurance time was not more than 100 hours and cracks and fissures were formed in the center part of the metal layer.

In the actual-device endurance paper-feed test which was conducted by mounting a heat fixing device of the belt heating type of the electromagnetic induction heating method, in the case of the mounting of the fixing belts of first to twenty-first Embodiments, 100,000 images were outputted without a trouble and the endurance test was finished. On the other hand, in the case of the mounting of the fixing belts of Comparative Examples 1 to 4, irregularities occurred in images with not more than 10,000 sheets and paper-feed itself became impossible in the course of time.

INDUSTRIAL APPLICABILITY

According to the present invention, it is possible to provide a fixing belt which is improved in wear resistance, thermal conductivity, thin wall designs, heat resistance and flexibility and a heat fixing device on which this fixing belt is mounted.

This application claims priority from Japanese Patent Application No. 2003-402911 filed on Dec. 2, 2003, which is hereby incorporated by reference herein.

The invention claimed is:

1. A metal belt, characterized in that the metal belt is made of a nickel-iron alloy manufactured by an electroforming process and that when the iron content of the nickel-iron alloy is denoted by F (mass %) and the sulfur content thereof is denoted by S (mass %), the nickel-iron alloy satisfies relationships expressed by the following equations:

$$0.001 \leqq S \leqq 0.13, \text{ and} \quad (1)$$

$$85 \times S+3 \leqq F \leqq 350 \times S+3. \quad (2)$$

2. The metal belt according to claim 1, characterized in that the sulfur content S (mass %) is $0.02 \leqq S \leqq 0.09$.

3. The metal belt according to claim 1, characterized in that the nickel-iron alloy contains carbon and that the carbon content (mass %) is 0.07 to 2 times the sulfur content (mass %).

4. A fixing belt having a metal layer, characterized in that the metal layer is made of a nickel-iron alloy manufactured by an electroforming process, and that when the iron content of the nickel-iron alloy is denoted by F (mass %) and the sulfur content thereof is denoted by S (mass %), the nickel-iron alloy satisfies relationships expressed by the following equations:

$$0.001 \leqq S \leqq 0.13, \text{ and} \quad (1)$$

$$85 \times S+3 \leqq F \leqq 350 \times S+3. \quad (2)$$

5. The fixing belt according to claim 4, characterized in that the sulfur content S (mass %) is $0.02 \leqq S \leqq 0.09$.

6. The fixing belt according to claim 4, characterized in that the nickel-iron alloy contains carbon and that the carbon content (mass %) is 0.07 to 2 times the sulfur content (mass %).

7. The fixing belt according to claim 4, characterized in that the fixing belt has a metal layer and a release layer.

8. The fixing belt according to claim 7, characterized in that the fixing belt has an elastic layer between the metal layer and the release layer.

9. The fixing belt according to claim 8, characterized in that the elastic layer is formed from silicone rubber, fluororubber and fluorosilicone rubber.

10. A heat fixing device, characterized in that the heat fixing device has a fixing belt and a pair of pressure contact members which are in pressure contact with each other via the fixing belt, that an inner surface of the fixing belt slides with one of the pair of pressure contact members, that an image is fixed on a recording material by heat from the fixing belt, and that the fixing belt is the fixing belt according to any one of the claims 4 to 9.

11. The heat fixing device according to claim 10, characterized in that the heat from the fixing belt is heat generated in the metal layer of the fixing belt by a magnetic flux generated from magnetic flux generating means.

12. The heat fixing device according to claim 10, characterized in that the heat from the fixing belt is heat generated in a heating body which is provided in the pressure contact member which slides with the belt.

* * * * *

UNITED STATES PATENT AND TRADEMARK OFFICE

CERTIFICATE OF CORRECTION

PATENT NO. : 7,376,379 B2
APPLICATION NO. : 10/580334
DATED : May 20, 2008
INVENTOR(S) : Junichi Takahashi et al.

It is certified that error appears in the above-identified patent and that said Letters Patent is hereby corrected as shown below:

COLUMN 4
Line 9, “, and” should read --in--.
Line 50, “heat” should be deleted.

COLUMN 6
Line 1, “mideimide-based” should read --mide-imide-based--.
Line 45, “temperatures” should read --temperature--.

COLUMN 11
Line 46, “indicted” should read --indicated--.

COLUMN 13
Line 15, “copper” should read --copper,--.

COLUMN 14
Line 26, “indicted” should read --indicated--.

COLUMN 15
Line 52, “us” should read --use--.

COLUMN 16
Line 53, “has” should read --had--.

COLUMN 17
Line 58, “sometimes” should read --sometimes be--.
Line 65, “and” should read --and are--.

COLUMN 18
Line 9, “belt.” should read --belts.--.

COLUMN 19
Line 31, “of” should read --of the--.
Line 48, “an nickel” should read --a nickel--.

UNITED STATES PATENT AND TRADEMARK OFFICE

CERTIFICATE OF CORRECTION

PATENT NO. : 7,376,379 B2
APPLICATION NO. : 10/580334
DATED : May 20, 2008
INVENTOR(S) : Junichi Takahashi et al.

It is certified that error appears in the above-identified patent and that said Letters Patent is hereby corrected as shown below:

COLUMN 20
Line 35, “first” should read --the first--.
Line 43, “twentieth” should read --the twentieth--.
Line 53, “in” should read --in the--.
Line 59, “first” should read --the first--.
Line 60, “a” should read --any--.

COLUMN 21
Line 1, “first” should read --the first--.
Line 11, “first” should read --the first--.
Line 13, “a” should read --any--.

Signed and Sealed this

Seventeenth Day of February, 2009

JOHN DOLL
*Acting Director of the United States Patent and Trademark Office*